United States Patent [19]

O'Brien et al.

[11] 3,960,738

[45] June 1, 1976

[54] METHOD FOR PRODUCING IMPROVED ELECTROGRAPHIC DEVELOPER

[75] Inventors: Robert J. O'Brien; Stanley Lelewski, Jr.; Bob A. LaFleur, all of Rochester, N.Y.

[73] Assignee: Eastman Kodak Company, Rochester, N.Y.

[22] Filed: Jan. 2, 1975

[21] Appl. No.: 538,062

[52] U.S. Cl. ..... 252/62.1 P; 209/129; 427/25; 427/294; 427/14

[51] Int. Cl.[2] ..... G03G 9/08; B03C 7/00

[58] Field of Search ..... 252/621; 209/129; 427/25, 294, 14

[56] References Cited

UNITED STATES PATENTS

| | | | |
|---|---|---|---|
| 2,187,637 | 1/1940 | Sutton et al. | 209/129 |
| 2,300,324 | 10/1942 | Thompson | 209/127 |
| 2,848,108 | 8/1958 | Brastad et al. | 209/129 |
| 3,477,568 | 11/1969 | Madrid | 209/129 |
| 3,635,340 | 1/1972 | Dunn | 209/130 |
| 3,662,884 | 5/1972 | Robinson | 209/129 |

*Primary Examiner*—Mayer Weinblatt
*Assistant Examiner*—John D. Smith
*Attorney, Agent, or Firm*—G. W. Neuner

[57] ABSTRACT

A method for preconditioning an electrographic developer comprising an unconsolidated mass of discrete particles of a carrier and of a toner which carries a charge control agent of negative or positive polarity, said method comprising repeatedly passing a flowing stream of such developer through an electrostatic field between a positive or negative electrode and a grounded electrode of opposite polarity, and attracting part of said toner particles to the electrode of sign opposite the sign of said charge control agent. The grounded electrode has an inclined surface and the stream of developer slides down such surface under the other electrode, which is parallel to the grounded electrode. The apparatus includes mixing mechanism for mixing the developer, and conveying mechanism for carrying mixed developer from the bottom of the inclined grounded electrode back to the top for repeated passage through the electrostatic field.

10 Claims, 7 Drawing Figures

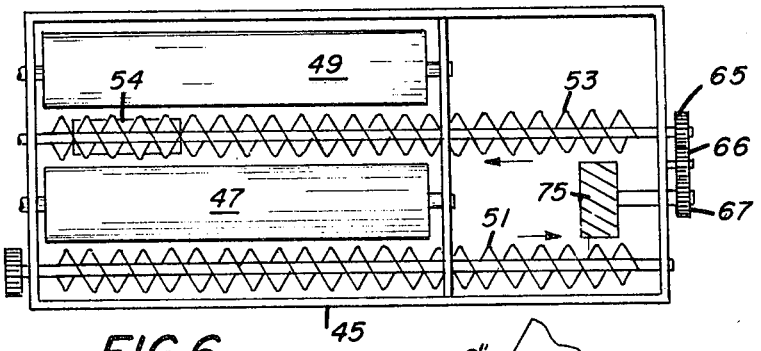
FIG. 6
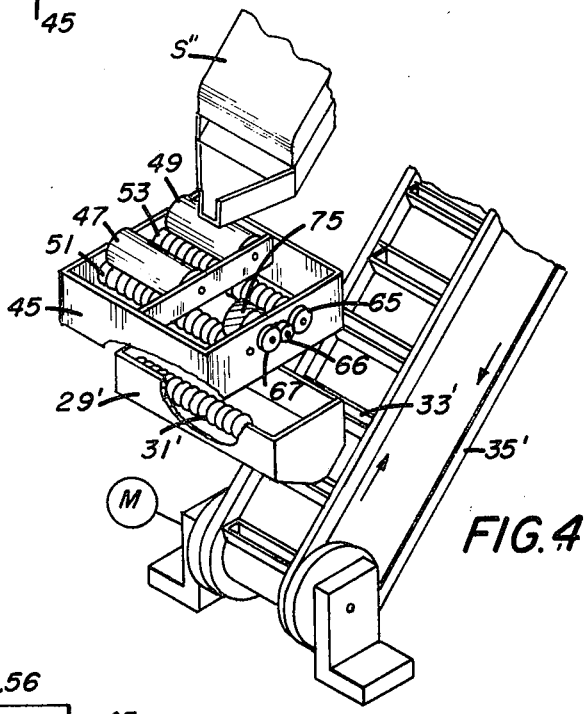
FIG. 4
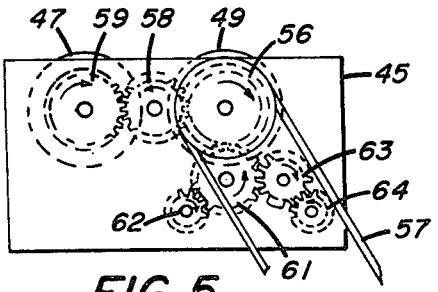
FIG. 5
FIG. 7
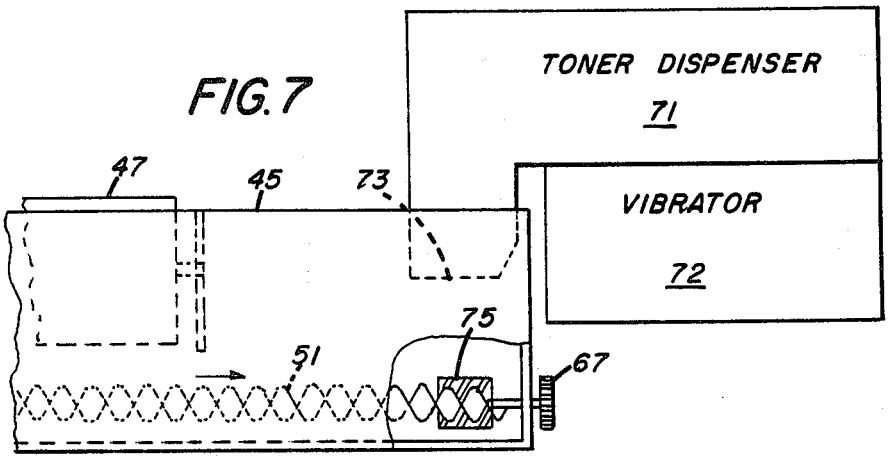

METHOD FOR PRODUCING IMPROVED ELECTROGRAPHIC DEVELOPER

Background of the Invention

1. Field of the Invention

This invention relates to electrography, and to an improved dry electrographic developer composition which is useful in the development of electrostatic charge patterns. More particularly, the invention relates to a method and apparatus for preparing an artificially aged or preconditioned dry electrographic developer having desirable characteristics which continue uniformly from the first prints through many thousands of prints. Previously available developers only attained such desirable characteristics after they had been aged in service, or if attained at the beginning of service, had tended to deteriorate as the number of prints increased. Developer produced by our novel method immediately provides prints which have image sharpness and image density which are superior to those produced with many previously available developers when first placed in service, which are equivalent in quality to those produced by many previously available developers after they have aged in service, e.g. after the preparation of several thousand prints, and which continue uniformly for many thousands of prints.

2. The Prior Art

Electrographic imaging and developing processes, and techniques, have been extensively described in both the patent and other literature, for example, U.S. Pat. Nos.: 2,221,776, issued Nov. 19, 1940; 2,277,013, issued Mar. 17, 1942; 2,297,691, issued Oct. 6, 1942; 2,357,809, issued Sept. 12, 1944; 2,551,582, issued May 8, 1951; 2,825,814, issued Mar. 4, 1958; 2,833,648, issued May 6, 1958; 3,220,324, issued November 30, 1965; 3,220,831, issued Nov. 30, 1965; 3,220,833, issued Nov. 30, 1965.

Generally these processes have in common the steps of forming an electrostatic charge pattern on an electrically insulating electrographic element. The electrostatic charge pattern is then rendered visible by a development step in which the charged surface of the electrographic element is brought into contact with a suitable developer mix. Conventional dry developer mixes include thermoplastic resin particles, known as toner particles, which may contain coloring agents, and may also include a carrier that can be either a magnetic material such as iron filings, powdered iron or iron oxide, or a triboelectrically chargeable, non-magnetic substance like glass beads or crystals of inorganic salts such as sodium or potassium fluoride. The toner typically comprises a resinous material, a colorant like dyestuffs or pigments such as carbon black, and may also contain other addenda such as plasticizers, charge control agents and the like.

One method for applying a suitable dry developer mix to a charged pattern-bearing electrographic element is by the magnetic brush process. Such a process generally utilizes an apparatus of the type described, for example, in U.S. Pat. No. 3,003,462, issued Oct. 10, 1961, which customarily comprises a non-magnetic rotatably mounted cylinder having fixed magnetic means mounted inside. The cylinder is arranged to rotate so that part of the surface is immersed in or otherwise contacted with a supply of developer mix. The granular mass comprising the developer mix is magnetically attracted to the surface of the cylinder. As the developer mix comes within the influence of the field generated by the magnetic means within the cylinder, particles arrange themselves in bristle-like formations resembling a brush. The brush formations that are formed by the developer mix tend to conform to the lines of magnetic flux, lying substantially flat in the vicinity of the poles, and standing erect when said mix is outside the environment of the magnetic poles. Within one revolution, the continually rotating cylinder picks up developer mix from a supply source and returns part or all of this material to this supply source. This mode of operation assures that fresh mix is always available to the surface of the charged electrographic element at its point of contact with the brush. In a typical rotational cycle, the roller performs the successive steps of developer mix pickup, brush formation, brush contact with the electrographic element, e.g. a photoconductive element, brush collapse, and finally developer mix release.

In magnetic brush development, as well as in various other types of electrographic development wherein a two-component dry triboelectric mixture of a particulate carrier and a toner powder are utilized, e.g., cascade development such as described in U.S. Pat. Nos. 2,638,416 and 2,618,552, it is advantageous to modify the surface properties of the toner powder so that a uniform, stable net electrical charge may be imparted to the toner powder by the particulate carrier.

One method of developer preparation has involved placing particles of a carrier and particles of toner (containing a charge control agent in the concentration desired in the final developer, generally about 0.1 to about 6 parts by weight per 100 parts of resin) in a container such as a churn, crock, cylinder or barrel, and then rotating the container on its longitudinal axis for a mixing period which generally is 24 hours or less. Then the developer is placed in the developer station of an electrophotographic apparatus and the printing process begins. Generally the prints gradually improve in pattern sharpness until about 10,000 prints have been made. There may also be a decrease in pattern density for the first 1000 to 5000 prints, followed by a gradual and desirable increase through the next 20,000 to 30,000 prints, after which pattern density remains essentially constant at a desirable density.

Pattern density varies significantly with changes in relative humidity. For example, when a fresh developer is used, the sensitivity to relative humidity changes decreases as the developer ages, in particular, the pattern density sensitivity at low relative humidity decreases.

Certain observations have been made concerning the possible causes for variations in developer performance. A decrease in pattern density occurs with increasing toner electrical charge. Toner charge, in turn, increases with decreasing average toner particle size and decreases with increasing carrier scumming (the physical transfer of toner components to the surfaces of the carrier particles).

The average particle size of free toner increases during the initial stages of mixing with porous carrier particles because the fine particles of toner pack or fill the void spaces of carrier particles. Also, the average toner particle size decreases rapidly in the early life of the developer in printing apparatus, because the printed patterns seem to be formed by a selection of the larger toner particles. As printing proceeds, the average particle size of toner particles in the developer charge approaches a value which is smaller than that in fresh developer, and smaller than that in any replenishing charge of toner which is added periodically.

The response of a toner concentration monitor is also sensitive to toner particle size variations. As the average particle size decreases, the carrier particle surface covered per unit weight of toner increases. This appears to the monitor as an effective concentration increase since the reflectance of the developer decreases, and the actual toner concentration decreases.

Developer resistance changes occur as a result of a) toner particle size variations, b) attrition in carrier particle size by physical action during circulation in the developer system, and c) scumming of the carrier particles.

Summary of the Invention

In accordance with the present invention, an artificially aged or preconditioned dry electrographic developer is prepared in accelerated fashion, so as to simulate the characteristics of a normally aged developer, by the steps of:

a. Combining an unconsolidated mass of finely divided carrier particles and an unconsolidated mass of particles of a toner which carries a charge control agent of a first polarity such as positive or negative, to form a developer.
b. A flowing stream of the developer is then passed repeatedly through an electrostatic field between either a positive or negative electrode and a grounded electrode of opposite sign. As the particles of toner and carrier rub together the toner becomes triboelectrically charged, positively or negatively depending on the charge control agent. Part of the charged toner particles are then attracted to the electrode which is of sign opposite the sign of the charge control agent, thus removing toner from the developer. The larger particles are first attracted, and during successive passes, successively smaller ones are attracted.

In a preferred embodiment the stream of dry developer slides downhill along an inclined plane surface of a grounded first electrode. A second electrode, of opposite sign to the charge control agent, is positioned above and parallel to the grounded first electrode to receive the attracted toner particles which can then be removed either periodically or continuously as will be described. When the charge control agent is positive, the second electrode is negative, and vice versa.

In order to compensate for the removal of toner by attraction to an electrode the developer is replenished either continuously or periodically with additional toner.

Developer can be supplied to the upper end of the grounded first electrode either manually or by an automatic conveyor apparatus; and recycling of developer can be done by transporting treated developer from adjacent the lower end of the grounded first electrode either manually or by automatic conveyor apparatus.

The voltage across the two electrodes advantageously is between 1000 and 20,000, the lower limit being operable at ¼ inch spacing and the upper at 2 inches spacing. 7,000 volts is an average value for successful operation when the space between electrodes is ¾ inch.

THE DRAWINGS

FIG. 4 is a perspective view of a part of a modified form of apparatus, having a mixing device for mixing replenishing toner into a developer;

FIG. 5 is an elevational view of the mixing device as seen from the left in FIG. 4;

FIG. 6 is a schematic plan view of the mixing device of FIG. 4; and

FIG. 7 is a front elevational view of the mixing device, together with a toner replenishing mechanism.

THE SPECIFIC EMBODIMENTS

Figure 2:
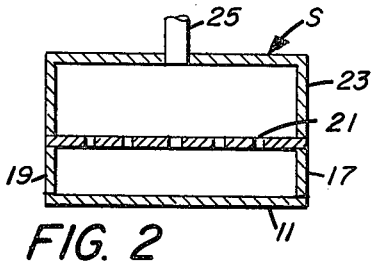
FIG. 2 is a cross sectional view taken along the line 2—2 in FIG. 1.
Figure 1:
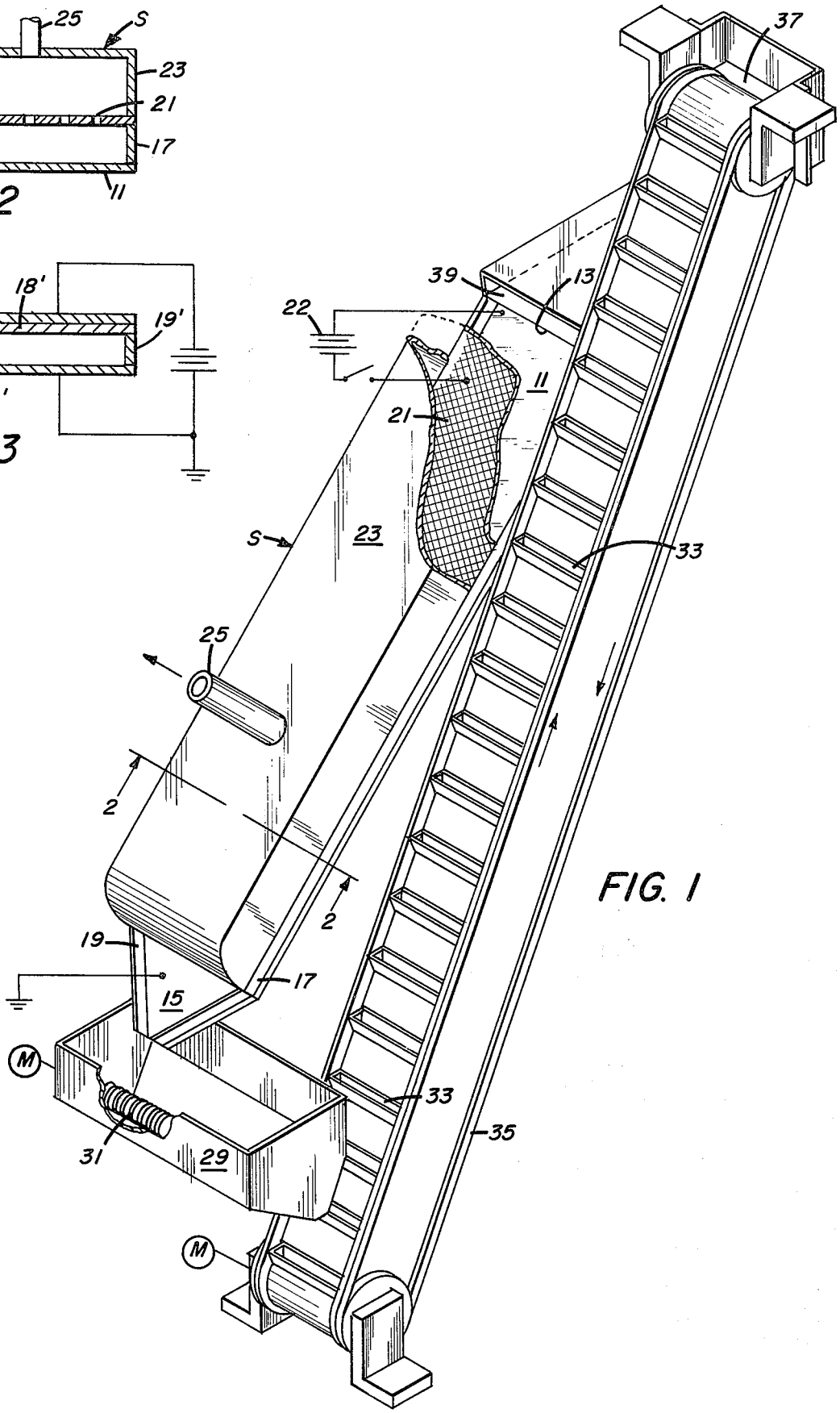
FIG. 1 is a perspective view, partly broken away and in section, of a preferred apparatus for performing the method, with provision for automatic mechanical recycling of developer and for continuously sucking attracted toner particles away from the upper electrode surface.

Referring to FIGS. 1 and 2, there is shown slide apparatus S comprising a first electrode 11 of metal, comprising a smooth plane imperforate sheet which is inclined downwardly at a 45° angle from an upper end 13, for receiving developer, to a lower end 15 for discharging developer. Side rails 17 and 19 of dielectric material such as rubber or a synthetic resin such as polyethylene border both edges of electrode 11 from top to bottom. A second electrode 21 of foraminous metal, such as metal screening or a perforated metal plate, lies on top of the side rails which thus space the two electrodes apart to provide space between for the passage of developer down the slide or channel formed by the cooperating parts described above.

Electrodes 11 and 21 are connected to opposite sides of a source of direct current 22 such as a rectified AC power supply, and electrode 11 is grounded to prevent shock.

A housing 23 rests on top of electrode 21 and is connected by a pipe 25 to a source of suction so as to suck away air and those toner particles which have been attracted to electrode 21. The toner particles removed can then be reground elsewhere and recycled into the developer.

The lower ends of electrode 11 and side rails 17, 19 are so shaped as to form a funnel-like discharge path for developer which can then be collected and recycled to the top of the slide in any desired way. We prefer recycling by an automatic conveyor mechanism which requires a minimum of operator attention. A trough 29 receives developer which is pushed over to one side by a motor driven feed screw 31 and leaves through an orifice or chute in the bottom of the trough. The developer then is conveyed by the trays or flights 33 of a motor-driven endless conveyor belt 35 from a position below the trough upwardly along an inclined path to a position above and to one side of the upper end 13 of the slide. Developer is discharged from the belt 35 into a hopper 37 and then flows down through an inclined chute 39 to deposit on the upper end 13 of the slide.

The developer in trough 29 can be replenished with additional toner by manually pouring it into the trough where it is mixed intimately into the developer by feed screw 31. Alternatively, replenishing toner can be continuously or periodically fed into trough 29 by a suitable apparatus such as a vibrating feeder, as described hereinafter.

When initiating operation the carrier and toner particles are mixed intimately together in trough 29 and cycled through the system for about 15 minutes, but with the voltage and suction off. After 15 minutes, the electric field is energized, suction is started, and toner replenishment is done as needed to maintain the concentration of toner at about 3¼% in the developer mix. Treatment is continued for 30 minutes, then the voltage and suction are turned off and mixing for 15 minutes again is done. Alternating mixing and preconditioning operations are continued for 3 hours, after which the developer is equivalent to a non preconditioned developer that has accumulated a print count of 20,000.

Figure 3:
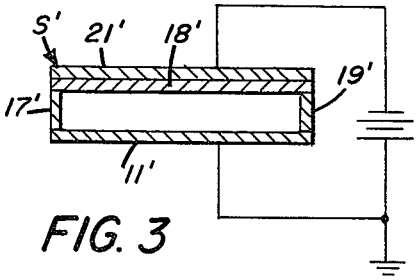
FIG. 3 is a cross sectional view similar to FIG. 2, of a different and simpler type of apparatus constructed for periodic manual removal of attracted toner from the upper electrode surface.

A simpler form of apparatus S′ embodying the invention, as shown in FIG. 3, does not have provision for sucking attracted toner particles away from the upper electrode 21′. Instead, there is a thin sheet 18′ of dielectric material such as paper which is carried on the under side of electrode 21′. Attracted toner particles adhere to the paper and are periodically removed with the paper, which is then replaced by a new sheet.

The parts of the slides S and S′ can be held together in any desired way, as by C-clamps or bolts.

Referring to FIGS. 4, 5 and 6, an even more fully automated apparatus includes mechanism for automatically supplying replenishing toner to, and mixing it with, the developer discharged from a slide S″.

In FIG. 4 a trough 29′ feeds developer to a conveyor 35′, as in FIG. 1. However, in this modification the developer from slide S″ enters an intermediate trough 45 before passing into trough 29′. In trough 45 the developer drops onto two cylindrical steel rollers 47 and 49 which rotate in the same direction and which have internal permanent magnets (not shown) that cause the rollers to act as magnetic brushes for thoroughly mixing added toner with the carrier particles. The surfaces of the rollers are shown as spaced well apart for simplicity, but in actual practice the surfaces are only spaced apart by a small distance such as about ¼ inch. Also, below the rollers 47 and 49 there are two parallel spaced conveyor screws or augers 51 and 53 which so rotate as to cause a circulation of developer back and forth within trough 45. Mixed developer drops continuously from trough 45 into trough 29′ through an opening (not shown) in the bottom of trough 45 near its left end.

As shown in FIG. 5 rotation of rollers 47 and 49, and of conveyor screws 51 and 53 is accomplished by a pulley 55 and associated gear 56 driven by a belt 57 connected to a motor (not shown). Pulley 55 directly drives the shaft of roller 49, and gear 56 is geared to a change gear 58 which drives a gear 59 which drives the shaft of roller 47 in the same direction as roller 49. Gear 56 also drives a second change gear 61 which drives a gear 62 at the end of conveyor screw 51. Second change gear 61 also drives a third change gear 63 which in turn drives a gear 64 on the end of conveyor screw 53. Thus conveyor screws 51 and 53 rotate in opposite directions. On the opposite end of screw 53 is a driving gear 65 connected through a change gear 66 to a driven gear 67 on the end of the shaft of a paddle wheel 75 which rotates in the same direction as screw 53.

FIG. 6 shows mechanism for continuously sifting replenishing toner from a vibrating trough 71 through holes 73 into the right end portion of trough 45 onto screws 51, 53 which so rotate that screw 51 carries developer from left to right to pick up new toner, and screw 53 carries replenished developer from right to left where it drops continuously down through an opening 54 into lower trough 29′. Mixing of new toner with developer, and distinegration of clumps, are assisted by rotating paddle wheel 75 within trough 45 directly under the discharge of trough 71. Trough 71 can be vibrated by a conventional vibrator 72, such as one driven by motor-actuated eccentric cams.

From lower trough 29′ the replenished developer is moved continuously by a rotating conveyor screw 31′ to the right end of the trough to discharge onto continuously operating conveyor 35′ and back to the top of slide S″ in the same way as described in connection with FIG. 1.

The carrier particles of this invention can be selected from a variety of materials, porous or non-porous, and generally range in size between 30 and 700 micrometers (preferably between 70 and 200, and even more usually between 105 and 177). Carriers include various nonmagnetic particles such as glass beads, crystals of inorganic salts such as sodium or potassium chloride, hard resin particles, metal particles, etc. In addition, magnetic carrier particles can be used in accordance with the invention. Suitable magnetic carrier particles are particles of ferromagnetic materials such as iron, cobalt, nickel, and alloys and mixtures thereof. Especially desirable are porous iron particles having oxidized surfaces such as those produced by the methods of U.S. Patents 3,632,512 and 3,767,477 or by acid washing, or by acid washing and nickel cladding of particles. Such porous particles can be packed in their pores with toner particles; thus altering the toner size distribution in the remaining free toner in the developer mass such as occurs in a naturally aged developer. Preconditioning also results from scumming of the carrier particles with charge control agent.

Other useful magnetic carriers are ferromagnetic particles overcoated with a thin layer of various film-forming resins, for example, the alkali-soluble carboxylated polymers described in Miller, U.S. Pat. No. 3,547,822, issued Dec. 15, 1970; Miller, U.S. Pat. No. 3,632,512, issued Jan. 4, 1972; McCabe, U.S. Ser. No. 236,765, filed Mar. 21, 1972, entitled "Electrographic Carrier Vehicle and Developer Composition — Case B"; Kasper et al, U.S. Ser. No. 236,584, now abandoned, filed Mar. 21, 1972, entitled "Electrographic Carrier Vehicle and Developer Composition — Case C"; and Kasper's U.S. Ser. No. 236,614, now U.S. Pat. No. 3,795,618 filed Mar. 21, 1972, entitled "Electrographic Carrier Vehicle and Developer Composition — Case D". Other useful resin coated magnetic carrier particles include carrier particles coated with various fluorocarbons such as polytetrafluoroethylene, polyvinylidene fluoride, and mixtures thereof including copolymers of vinylidene fluoride and tetrafluoroethylene.

The resins useful for the toners in the practice of the present invention can be used alone or in combination, and include those resins conventionally employed in electrostatic toners. Useful resins generally have a glass transition temperature within the range of from 60° to 120°C. Preferably, toner particles prepared from these resinous materials have a relatively high caking temperature, for example, higher than about 55°C, so that the toner powders may be stored for relatively long periods of time at fairly high temperatures without having individual particles agglomerate and clump together. The melting point of useful resins preferably is within the range of from about 65°C to about 200°C so that the toner particles can readily be fused to conventional paper receiving sheets to form a permanent image. Especially preferred resins are those having a melting point within the range of from about 65°C to about 120°C. Of course, where other types of receiving elements are used, for example, metal plates such as certain printing plates, resins having a melting point and glass transition temperature higher than the values specified above may be used.

As used herein, the term "melting point" refers to the melting point of a resin as measured by Fisher Johns apparatus, Fisher Scientific Catalog No. 12-144. Glass transition temperature (Tg), as used herein, refers to the temperature at which a polymeric material changes from a glassy polymer to a rubbery polymer. This temperature (Tg) can be measured by differential thermal analysis as disclosed in *Techniques and Methods of Polymer Evaluation*, Vol. 1, Marcel Dekker, Inc., N.Y. 1966.

Among the various resins which may be employed in the toner particles of the present invention are polystyrene, polyurethane, polycarbonates, resin modified maleic alkyd resins, polyamides, phenol-formaldehyde resins and various derivatives thereof, polyester condensates, modified alkyd resins and the like, aromatic resins containing alternating methylene and aromatic units such as described in Merrill et al, U.S. Ser. No. 168,389, now U.S. Pat. No. 3,809,554 filed Aug. 2, 1971, and the like.

Typical useful toner resins include certain polycarbonates such as those described in U.S. Pat. No. 3,694,359, issued Sept. 26, 1972, and which includes polycarbonate materials containing an alkylidene diarylene moiety in a recurring unit and having from 1 to about 10 carbon atoms in the alkyl moiety. Other useful resins having the above-described physical properties include polymeric esters of acrylic and methacrylic acid such as poly(alkylacrylate) including poly(alkylmethacrylate) wherein the alkyl moiety can contain from 1 to about 10 carbon atoms. Additionally, other polyesters having the aforementioned physical properties are also useful. Among such other useful polyesters are copolyesters prepared from terephthalic acid including substituted terephthalic acid, a bis(hydroxyalkoxy) phenylalkane having from 1 to 4 carbon atoms in the alkoxy radical and from 1 to 10 carbon atoms in the alkane moiety and including such halogen substituted alkanes, and an alkylene glycol having from 1 to 4 carbon atoms in the alkylene moiety.

Other useful resins are various styrene-containing resins. Such polymers typically comprise a polymerized blend of from about 40 to about 100 percent by weight of styrene, from about 0 to about 45 percent by weight of a lower alkyl acrylate or methacrylate having from 1 to about 4 carbon atoms in the alkyl moiety such as methyl, ethyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. A typical styrene-containing resin prepared from a copolymerized blend as described hereinabove is a copolymer prepared from a monomeric blend of 40 to 60 percnt by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate. A variety of other useful styrene containing toner materials are disclosed in the following U.S. Pat. Nos.: 2,917,460, issued Dec. 15, 1959; Re. 25,136, issued Mar. 13, 1962; 2,788,288, issued Apr. 9, 1957; 2,638,416, issued Apr. 12, 1953; 2,618,552, issued Nov. 18, 1952; and 2,659,670, issued Nov. 17, 1953.

The toner particles which are used in the present invention can be prepared by various methods. One convenient technique for preparing these toners is spray-drying. Spray-drying involves dissolving the polymer in, and adding the toner colorant and charge control agent to, a volatile organic solvent such as dichloromethane. This solution is then sprayed through an atomizing nozzle using a substantially nonreactive gas such as nitrogen as the atomizing agent. During atomization, the volatile solvent evaporates from the airborne droplets, producing toner particles of the uniformly dyed or pigmented resin. The ultimate particle size is determined by varying the size of the atomizing nozzle and the pressure of the gaseous atomizing agent. Particles of a diameter between about 0.1 micrometers and about 100 micrometers may be used, although present day office copy devices typically employ particles between about 1.0 and 30 micrometers. However, larger particles or smaller particles can be used where desired for particular methods of development or particular development conditions. For example, in powder cloud development such as described in U.S. Pat. No. 2,691,345, issued Oct. 12, 1954, extremely small toner particles are used.

Another convenient method for preparing the toner composition of the present invention is melt-blending. This technique involves melting a powdered form of polymeric resin and mixing it with suitable colorants, such as dyes or pigments, and the charge control agent. The resin can readily be melted on heated compounding rolls which are also useful to stir or otherwise blend the resin and addenda so as to promote the complete intermixing of these various ingredients. After thorough blending, the mixture is cooled and solidified. The resultant solid mass is then broken into small particles and finely ground to form a free-flowing powder of toner particles. These particles typically have an average particle size or average diameter within the range of from about 0.1 to about 100 micrometers.

The charge control agent can be a salt of positive polarity which is incorporated in a dry, particulate toner composition, as described above, comprising a resin, and, if desired, a suitable colorant such as a pigment or dye. This agent can be added in an amount between 0.5 and 6.0 parts per hundred parts of resin, by weight; preferably 1 part charge agent per 100 parts of resin, which is 0.93% by weight of total toner; actual analysis showed 0.83%. Particularly useful as charge control agents are quaternary ammonium salts having the following formula:

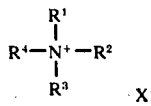

wherein $R^1$, $R^2$, $R_3$, and $R^4$, which may be the same or different, represent an aliphatic hydrocarbon group having 7 or less, preferably 3 to 7, carbon atoms, including straight-chain and branched-chain aliphatic hydrocarbon groups, and $X^-$ represents an anionic function. Toner compositions containing such salts are described and claimed in U.S. Ser. No. 399,226, the disclosure of which is incorporated by reference herein.

The quaternary ammonium salt charge control agents, when incorporated in the toner materials of the present invention, have been found surprisingly effective in providing a particulate toner composition which exhibits a relatively high, uniform and stable net toner charge when admixed with a suitable particulate carrier vehicle, and which also exhibits a minimal amount of deleterious toner throwoff. This charge control agent has been found substantially more effective than the long-chain quaternary ammonium surfactant materials which previously have been incorporated in toner compositions. More specifically, the quaternary ammonium salts described above have been found to exhibit a substantially higher net toner charge and a substantially lower toner throw-off than long-chain quaternary ammonium salt surfactants (or wetting agents as they are sometimes called). In addition, quaternary ammonium charge control agents described above have been found to have no deleterious effect on the adhesion properties of the resultant toner composition to conventional paper receiving sheets.

Furthermore, toners containing quaternary ammonium salts as described above exhibit substantially better "charge control" properties than toner compositions containing other types of onium salts, e.g., sulfonium, phosphonium, pyridinium, or quinolinium salts.

Moreover, it has been found that particulate resinous toner particles containing an effective amount of the above described quaternary ammonium charge control agents generally result in good-to-excellent electrographic developed patterns exhibiting increased and uniform density with little or no background scumming of the receiver sheets, particularly after preconditioning by the method of the present invention.

Still another charge control agent which is useful in toners which are used for preparing a preconditioned developer in accordance with the method of the present invention, is an ethoxylated amine such as one of those available from the Armak Chemical Corporation under the trademark Ethomeen, as described in U.S. Ser. No. 470,425, filed May 16, 1974 by T. A. Jadwin and R. C. Storey, the disclosure of which is incorporated by reference herein. Such compositions are ethylene oxide condensation products of primary fatty amines, and the ones which offer the greatest utility in this invention are those of the formula:

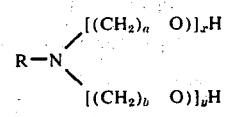

wherein $a$ and $b$ represent integers of from about 2 to 4 and may be the same or different, $x$ and $y$ represent integers of from about 1–10 and may be the same or different, and R is an alkyl group containing from about 8 to about 30 carbon atoms.

This agent can be added in an amount between 0.5 and 5.0 parts per hundred parts of polymeric resin, by weight; preferably 1 part charge agent per hundred parts resin, which is 0.943% by weight of total toner; actual analysis showed 0.90%.

The toner compositions utilized in the present invention may or may not contain a colorant such as a dye or carbon black, which is dissolved or mixed into the resin for producing the desired final color which normally is black.

The invention is further illustrated by the following examples of its practice.

Example 1

A developer was prepared by adding 3¼% by weight of toner to 6 kg of carrier and stirring by hand using a large mixing spoon. The developer was than passed down the slide shown in FIG. 1, minus the conveyor 35 and trough 29, using a spacing of ¾ inch between the negative upper perforated plate and the lower grounded slide plate. A potential of 7 kilovolts was used between the plates and a vacuum was drawn on the perforated plate to remove toner. The developer was collected in a bucket at the bottom of the slide, then recycled manually to the top of the apparatus to make another pass down the slide. After 5 passes down the slide, the toner concentration was checked and found to be 2.3%. Sufficient replenishing toner was added to bring the concentration back to 3.25% and the developer was mixed on a jar mill for 15 minutes. The entire procedure was repeated with the number of passes varying between 5 and 16 before concentration was rechecked. After a total of 346 passes, 1600 grams of toner had been used as replenisher and dividing an assumed toner usage rate of 0.05 grams/print and correcting for the normal brush load, the developer had aged or was preconditioned an equivalent 18.7 thousand prints. This developer was placed in an electrostatic printing apparatus and gave excellent print density stability from the beginning of the test. Four other developers which had been preconditioned the same way also gave excellent stability from the beginning when used in different electrostatic printers.

The table below shows the relationship between the number percent in any size class of toner versus equivalent prints.

| Toner size micrometers | Equivalent prints (thousands) 0 | 1.4 | 5 | 9.3 | 12.8 | 18.7 |
|---|---|---|---|---|---|---|
| | Percent of Total Number of Particles | | | | | |
| 1.26–1.59 | 4.9 | 3.2 | 2.8 | 3.6 | 3.1 | 2.8 |
| 1.59–2.00 | 2.1 | 1.6 | 1.8 | 2.2 | 2.1 | 1.9 |
| 2.00–2.52 | 1.7 | 1.6 | 1.8 | 2.2 | 2.1 | 2.6 |
| 2.52–3.17 | 1.7 | 2.1 | 2.5 | 2.9 | 3.3 | 4.2 |
| 3.17–4.00 | 1.9 | 3.1 | 4.4 | 5.9 | 7.1 | 9.2 |

-continued

| Toner size micrometers | Equivalent prints (thousands) 0 | 1.4 | 5 | 9.3 | 12.8 | 18.7 |
|---|---|---|---|---|---|---|
| | Percent of Total Number of Particles | | | | | |
| 4.00–5.04 | 2.6 | 6.3 | 9.9 | 14.2 | 16.0 | 18.2 |
| 5.04–6.35 | 6.8 | 14.9 | 21.4 | 25.2 | 24.5 | 24.1 |
| 6.35–8.00 | 17.3 | 23.7 | 25.5 | 21.4 | 20.1 | 19.0 |
| 8.00–10.08 | 29.8 | 26.7 | 19.2 | 12.9 | 13.1 | 11.8 |
| 10.08–12.70 | 23.1 | 13.5 | 8.4 | 6.7 | 6.4 | 4.8 |
| 12.70–16.00 | 7.6 | 2.8 | 2.1 | 2.1 | 1.4 | 1.1 |
| 16.00–20.00 | 1.1 | 0.3 | 0.2 | 0.3 | 0.1 | 0.1 |
| 20.00–25.40 | 0.1 | 0.0 | 0.0 | 0.0 | 0.0 | 0.0 |

Example 2

A developer was prepared by the addition of 3¼% of toner having the same chemical composition as in Example 1 to 3.5 kg of the same carrier as in Example 1 and stirred by hand using a large mixing spoon. The developer was then placed in the hopper of the automated electrostatic slide shown in FIG. 4, having ¾ inch spacing between electrodes, and allowed to mix for 15 minutes by circulating through the slide with both the vacuum and electric field off. The voltage (set at 5 kilovolts) and vacuum were then turned on for 15 minutes. Toner was replenished using the shaker replenisher mounted over the mixing hopper. The replenishment rate had been set at a predetermined rate to keep the toner removed by electrostatic means and toner replenished in equilibrium.

The electrostatic cycle of 15 minutes on and 15 minutes off was repeated for a total of 3 hours. Particle size distribution of the toner was measured at 0 and 3 hours. The table below shows the relationship between the number percent in any size class at the beginning and after 3 hours treatment.

| Toner Size micrometers | Percent of Total Number of Particles 0 Hours | 3 hours |
|---|---|---|
| 1.26–1.59 | 10.7 | 5.8 |
| 1.59–2.00 | 3.6 | 5.6 |
| 2.00–2.52 | 2.6 | 7.4 |
| 2.52–3.17 | 2.6 | 11.5 |
| 3.17–4.00 | 3.2 | 16.7 |
| 4.00–5.04 | 5.6 | 18.0 |
| 5.04–6.35 | 9.8 | 15.3 |
| 6.35–8.00 | 16.2 | 9.1 |
| 8.00–10.08 | 20.1 | 5.6 |
| 10.08–12.70 | 16.6 | 3.4 |
| 12.70–16.00 | 6.9 | 0.2 |
| 16.00–20.20 | 0.1 | 0 |
| 20.20–25.40 | 0 | 0 |

Based on previous correlations between particle distributions and printing results, this toner should give excellent stability of print density from the beginning in an electrostatic printer.

The invention has been described in detail with particular reference to preferred embodiments thereof, but it will be understood that variations and modifications can be effected within the spirit and scope of the invention.

We claim:

1. A method for preconditioning an electrographic developer comprising an unconsolidated mass of discrete particles of a carrier and of a toner which carries a charge control agent of a first polarity, said method comprising repeatedly passing a flowing stream of such developer through an electrostatic field between a positive or negative first electrode and a grounded electrode of opposite polarity, and attracting part of said toner particles to the first electrode having polarity opposite the polarity of said charge control agent thereby altering the particle size distribution of the toner and yielding a preconditioned electrographic developer.

2. A method in accordance with claim 1 wherein said grounded electrode has an inclined surface, wherein said stream of developer slides downhill along said inclined surface, and wherein said first electrode having polarity opposite to said charge control agent is positioned above and parallel to said grounded electrode.

3. A method in accordance with claim 2, wherein the attracted particles adhere to said first electrode.

4. A method in accordance with claim 2 wherein said first electrode is perforate, said method also comprising sucking the attracted particles through perforations in said first electrode.

5. A method in accordance with claim 1, also comprising replenishing said developer with additional toner to compensate for the particles attracted to said first electrode.

6. A method in accordance with claim 1 wherein said charge control agent is positive and said first electrode is negative.

7. A method in accordance with claim 1 wherein said charge control agent is negative and said first electrode is positive.

8. A method for preconditioning an electrographic developer comprising an unconsolidated mass of discrete particles of a carrier and of a toner which carries a charge control agent of a first polarity, said method comprising establishing an electrostatic field between spaced opposed stationary and continuous flat electrodes at least one of which has a polarity opposite said first polarity, and repeatedly passing a flowing stream of such developer between said electrodes to attract part of said toner particles to such one electrode thereby altering the particle size distribution of the toner and yielding a preconditioned electrographic developer.

9. A method for preconditioning an electrographic developer comprising an unconsolidated mass of discrete particles of a carrier and of a toner which carries a charge control agent of a first polarity, said method comprising establishing an electrostatic field between spaced opposed flat inclined electrodes arranged one below the other, at least one of which has a polarity opposite said first polarity, and repeatedly passing a flowing stream of such developer slidingly down along the surface of the lower one of said electrodes to attract part of said toner particles to the upper one of said electrodes thereby altering the particle size distribution of the toner and yielding a preconditioned electrographic developer.

10. A method in accordance with claim 9 wherein the upper of said electrodes is perforate, said method also comprising sucking the attracted particles through said upper electrode.

* * * * *